United States Patent [19]

Manizza

[11] 4,351,473

[45] Sep. 28, 1982

[54] TRAY CONTAINER WITH TEAR OUT COVER

[75] Inventor: Guelfo A. Manizza, Blauvelt, N.Y.

[73] Assignee: Federal Paper Board Co., Inc., Montvale, N.J.

[21] Appl. No.: 207,682

[22] Filed: Nov. 17, 1980

[51] Int. Cl.[3] ..... B65D 5/64; B65D 5/54

[52] U.S. Cl. ..... 229/43; 206/612; 206/628; 206/633

[58] Field of Search ..... 229/43, 3.5 R, 2.5 R; 206/612, 628, 631, 633

[56] References Cited

U.S. PATENT DOCUMENTS

| | | | |
|---|---|---|---|
| 2,988,208 | 6/1961 | Loew | 229/2.5 R |
| 2,990,948 | 7/1961 | Zackheim | 229/2.5 R |
| 3,159,303 | 12/1964 | Betner | 206/628 |
| 3,185,578 | 5/1965 | Scharre | 206/628 |
| 3,186,623 | 6/1965 | Guyer | 206/612 |
| 3,202,271 | 8/1965 | Kirk | 206/628 |
| 3,244,356 | 4/1966 | Wolowicz et al. | 229/43 |
| 3,298,593 | 1/1967 | Stephenson | 206/628 |
| 3,391,852 | 7/1968 | Waldrop | 229/43 |
| 3,865,302 | 2/1975 | Kane | 229/43 |
| 4,019,675 | 4/1977 | Anderson et al. | 229/43 |

*Primary Examiner*—Stephen P. Garbe

*Attorney, Agent, or Firm*—FitzGibbon, Roehrig, Greenawalt & Stone

[57] ABSTRACT

A tray-type container is disclosed which is formed from paperboard having a coating of heat sealable and heat resistant film material and which, when fully set-up has a rectangular bottom wall with upstanding side walls which are connected at the corners by folded triangular web members and which have an outwardly directed flange formation at the top edges on which the margins of a lid member of the same material may be adhesively secured with provision for tearing out the major portion of the lid member so as to uncover the contents in the tray while leaving substantial marginal portions of the lid member intact and secured in reinforcing relation on the tray flange.

6 Claims, 9 Drawing Figures

GRAIN

TRAY CONTAINER WITH TEAR OUT COVER

BACKGROUND OF THE INVENTION

This invention relates to containers and is particularly concerned with improvements in product containers which are in the form of a tray and which may be fabricated from paperboard of a character which will enable the container to serve the dual purpose of packaging the product and permitting it to be processed in the same container.

Tray containers have been developed heretofore which are particularly adapted for use in the marketing of a bakery product where the container may be of a character which will permit the product to be processed in the container in which it is packaged. Products such as cakes, pastry, and the like which are generally in a flowable state initially, that is, in a liquid or semi-liquid condition, require that the container be leakproof when filled to a predetermined level with the product and capable of withstanding oven temperatures during the baking process without being destroyed by the heat in the oven. For such products, the containers most commonly employed are formed from thin metal foil or relatively stiff metallic sheet material which can be pressed or shaped to the desired form and serve as part of the package in which the product is marketed. Such containers are generally expensive and lacking in esthetic appeal since they do not readily accept the inks commonly employed in decorative printing. Efforts have been made, with some degree of success, to provide non-metallic trays which are suitable for this purpose. One such tray structure is disclosed in U.S. Pat. No. 4,114,797 granted to Guelfo A. Manizza Sept. 19, 1978. Another tray construction of this type, which is formed from paperboard having a filmlike heat resistant coating is disclosed in co-pending application Ser. No. 148,908 filed May 12, 1980 by Guelfo A. Manizza and William M. Brown which has been developed for handling bakery products, such as bread, where a rectangular shape is desired so that the finished product will have the conventional rectangular shape of a loaf of bread. In trays of this type having a coating in the form of a plastic film, the plastic film generally has shrink characteristics which differ from paperboard with the result that the side walls will buckle and have an unattractive appearance unless some provision is made to overcome the difference in shrinkage such as the scoring or cutting arrangement employed in Ser. No. 148,908 at the fold line between the side wall panels and the flange which is most often desired so as to seat thereon the margins of a lid or for other reasons.

Experience with tray structures of this type having a top flange on the side walls has shown that there is a need for a construction which will permit reinforcing the side walls against buckling or bulging and which will enable a satisfactory lid structure to be employed without detracting from the advantages obtained by the use of the flange and the film coated material.

It is a general object, therefore of the present invention to provide an improved lid structure for open top trays of the type described which affords greater rigidity in the side walls, and provides the tray with greater capability in use, and which is economical to produce so as to compete with trays formed of metal foil, and the like.

It is a more specific object of the invention to provide an improved lid structure and a method of securing the same on the top edge flange of a tray like container which is fabricated from a paperboard blank, preferably coated with a film forming heat resistant plastic material, which is cut and scored, so that it can be set-up with side wall panels upstanding from a rectangular bottom wall panel and connected at the corners by pairs of integral web members which are folded upon each other and secured against the faces of side walls, which have narrow top flanges for reinforcing the side walls and on which margins of the lid may be secured with the lid having provision for tearing out the major portion so as to expose the contents while leaving the marginal portions intact and secured in side wall reinforcing relation on the top edge flange.

The herein disclosed and claimed invention comprises a lid or cover for a tray structure of the type having upstanding side walls with a relatively narrow top edge flange, which tray structure is fabricated from a cut and scored blank of paperboard material, with the top edge flange formation adapted to be adhesively adhered beneath the margins of the cover member and the cover member being cut scored on opposite faces adjacent its peripheral margins so that the major portion which the cut-scores surround may be torn out and a marginal strip will remain adhered to the top face of the tray flange so as to stiffen the flange and side wall.

DESCRIPTION OF THE PREFERRED EMBODIMENT OF THE INVENTION

Figures 6, 7, 8, 9:
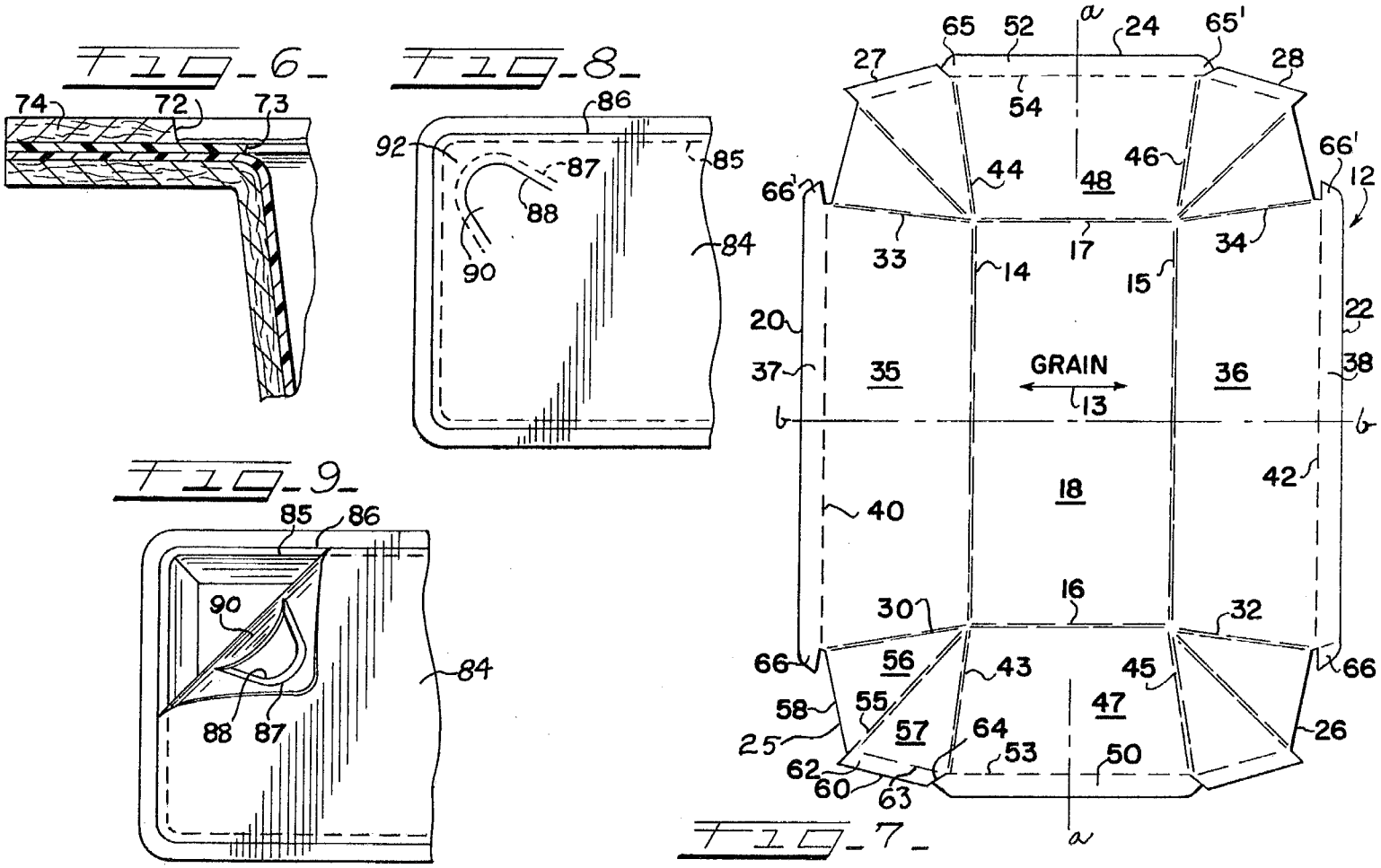
FIG. 6 is a fragmentary cross-sectional view taken on the line 6—6 of FIG. 4, to a greatly enlarged scale.
FIG. 7 is a plan view, showing the inside face of a blank which is cut and scored preparatory to the forming of the tray shown in FIG. 1.
FIG. 8 is a partial plan view showing a modified cover member.
FIG. 9 is a partial plan view illustrating the start of the tearing out of the modified cover member.

Referring to the drawings, there is illustrated a tray-type container or carton 10 which is adapted for use in the preparation and marketing of bakery products, particularly, bread, the tray structure being fabricated from a single sheet of flexible paperboard material which is coated with a heat resistant film and which is cut and scored as illustrated in FIG. 7. It will be understood that the container shown in the drawings is described and illustrated for the purpose of setting forth the presently preferred form of the invention and that the principles of the invention may be otherwise applied.

The tray 10, as illustrated in FIGS. 1 to 6, is fabricated from the cut and scored blank 12 which is shown in FIG. 7 with the face uppermost which will become the inside face in the set-up tray. In the form illustrated, the blank 12 is prepared from paperboard, of relatively light weight or gauge, which is coated or laminated with a suitable material to render it more resistant to damage when subject to high temperatures, such as baking oven temperatures. The illustrated material is paperboard provided with a coating of plastic film material which will incresae its resistance to absorption of heat to the degree desired for withstanding baking oven temperatures and which will also permit heat sealing of the coated surface to the paperboard surface. A suitable treatment of paperboard stock to form the blank 12 is set forth in U.S. Pat. No. 3,904,104 granted Sept. 9, 1976 to William Paul Kane.

The blank 12 is particularly designed to form a tray for processing a loaf of bread, having a somewhat greater length than width. The blank is in the form of a generally rectangular sheet of the foldable material having a substantially greater length than width, which is cut so that the grain is in the direction of the width or shortest dimension of the blank, as indicated by the arrow 13 in FIG. 7. The blank is cut and scored or creased, so that it is symmetrical about longitudinal and transverse center lines a—a and b—b. It is divided by parallel longitudinally extending, transversely spaced, hinge forming score or crease lines 14, 15 and by parallel transversely extending, longitudinally spaced, hinge forming score or crease lines 16, 17 which define a bottom wall forming center panel 18 with its edges coinciding with the bottom edges of sidewall forming panel portions 20 and 22, and end wall forming panel portions 23 and 24. The side and end wall panel portions 20, 22 and 23, 24 are connected at the four corners of the blank by corner connecting web portions 25, 26, 27 and 28. The transverse score lines 16 and 17 are extended at their opposite ends on lines 30, 32, 33 and 34, respectively, which are on a slight angle or inclination in the direction of the opposite ends of the blank and which define the opposite ends of side wall panels 35 and 36. The side wall panels 35 and 36 have relatively narrow flange forming edge reinforcing panel portions 37, 38 which extend along the free outer margins thereof and which are divided therefrom by combination cut and creased lines 40 and 42, the latter being parallel with and spaced outwardly of the score lines 14 and 15, respectively. The longitudinal score lines 14 and 15 are extended at their opposite ends on lines 43, 44 and 45, 46 which are at a slight angle or inclination in the direction of the opposite sides of the blank and which define the ends of end wall panels 47 and 48. The end wall panels 47 and 48 have outboard margins with relatively narrow edge reinforcing panel portions 50 and 52 which are divided therefrom by combination cut and creased lines 53 and 54, the latter being parallel with and spaced outwardly of the score lines 16 and 17, respectively. The corner connecting web panels 25, 26, 27, 28 are each divided in an identical manner and only one will be described in detail. The corner web panel 25 is divided by a center fold forming score line 55, so as to form pairs of triangular web panels 56, 57. The pair of triangular panels 56, 57 connect side and end wall panels 35, 47, while a corresponding pair of panels formed in the corner web panel 26 connect side and end wall panels 36 and 47 at that end of the blank. At the other end of the blank pairs of triangular panels in corner web panels 27 and 28 connect the end wall panels 35 and 36. The outside edges of the corner web panels 56 and 57 are cut on lines 58 and 60 which are approximately normal to the score lines 30 and 43 which define the ends of the associated side wall and end wall panels 35 and 47. The triangular web panel 57, which adjoins the end wall forming panel 47 has a narrow edge flange forming panel portion 62 which is divided thereform by a combination cut and scored line 63 which is parallel with and spaced inwardly of edge line 60. The panel 62 will have a width somewhat less than the width of the associated flange forming panel 37, which permits the panel 62 to be folded and engaged beneath the end of the associated flange forming panel 37 when the corner web panels 56 and 57 are folded into overlying relation with and along the top outside margin of the associated side wall panel 35. The flange forming panel 62 is cut, at the end adjoining the end flange forming panel 50, on the line 64 so as to leave the panel 50 with a small tab 65 extending from the end thereof. The opposite end of flange panel 50 is cut to form a like tab 65' and the flange panel 52 on the end wall panel 48 is provided with like tabs 65, 65' in the same manner. The flange forming panels 37 and 38 on the long length side wall forming panels 35 and 36 are each extended at their opposite ends to provide integral corner connecting tabs 66 and 66'. These tabs 66, 66' on the flange panels 37, 38 extend beyond the transverse hinge fold lines 30, 32 and 33, 34 and are cut so as to overlie the end tabs 65, 65' on the flange members 50 and 52 on the end panels 47, 48 when the tray is set up.

The combination cut and scored lines referred to may be formed by "skip cutting" or "cut scoring" the blank material, that is, by cutting on these lines closely spaced cuts of relatively small length which extend through the plastic film coating but not through the paperboard with which the film forms a laminate. The intervals between the small lengths cuts may or may not be creased, since the cuts will define the hinge fold line for the relatively light gauge paperboard sa well as a means for relieving the tension in the film.

In setting up the tray 10 from the blank 12, the end wall panels 47 and 48 may be folded on the hinge lines 16 and 17 simultaneously with the folding of the side wall panels 35 and 36 about the hinge lines 14 and 15. The corner connecting web structures 25, 26 and 27, 28 will fold with the end and side wall panels with which they are integrally connected and the two halves of each such corner structure will fold upon themselves and about the hinge lines 30, 33 and 32, 34 with the folded panels being directed into overlying relation on the end portions of the outside faces of the side wall panels 35 and 36, leaving the small, narrow flange forming panels 62 on the web panels positioned with the coated or film side or face exposed for heat sealing to the outside faces of the end portions of the flange forming panels 37, 38 on the side walls 35, 36. The end wall forming panels 50 and 52 will be folded into outwardly directed flange position followed by folding of the flange portions 37, 38 so as to bring the end tabs 66, 66' on the flange panels 37 and 38 into overlying sealed relation.

Figure 1:
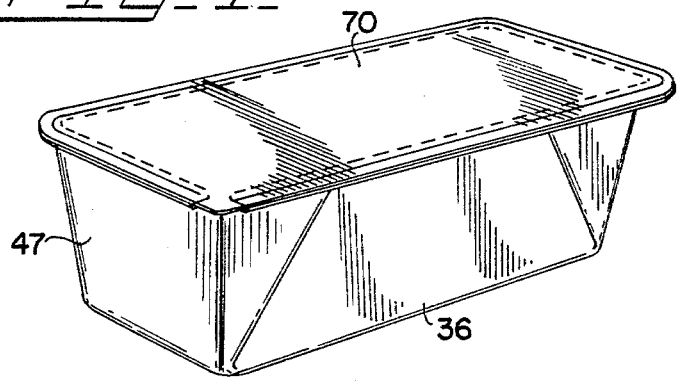
FIG. 1 is a perspective view of a tray-type container with a top cover member secured thereon which embodies the principal features of the invention.
Figure 2:
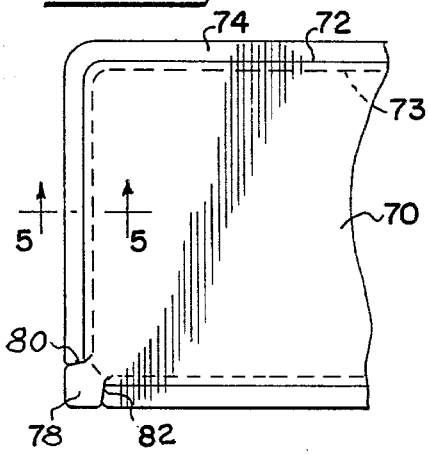
FIG. 2 is plan view of a portion of the top of the tray container as shown in FIG. 1.
Figure 4:
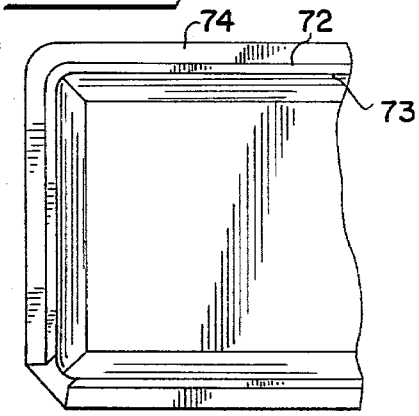
FIG. 4 is a plan view of a portion of the tray in FIG. 1 with the major portion of the top cover member torn out.
Figure 3:
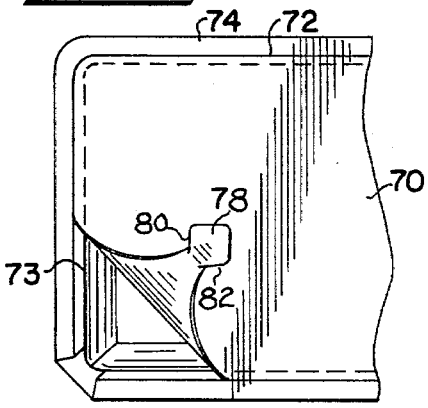
FIG. 3 is a partial plan view illustrating the start of the cover tearing operation.
Figure 5:
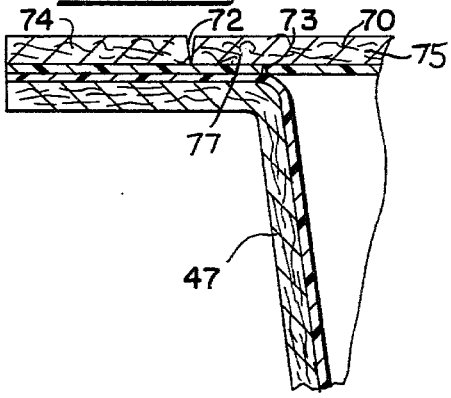
FIG. 5 is a fragmentary cross-sectional view taken on line 5—5 of FIG. 2 to a greatly enlarged scale.

In the form of the tray illustrated the plastic film material and the paperboard material have sufficiently different shrinking and stretching characteristics when heated and cooled so that the side walls will normally tend to buckle due to this difference. This tendency is releaved somewhat by the flange and the corner connecting web arrangement and also by cut scoring on the flange hinge lines. The buckling tendency is further reduced by the application of a cover member or lid 70 which is adapted to be applied with its margins adhesively secured to the flanges 37, 38 and 50, 52 so as to seal the contents in the tray. The lid or cover member 70 is especially formed from a paperboard sheet or blank having a film coating on the surface of the same character as the film on the tray, with the film coated face adapted to become the inside face when secured on the tray. It is cut with its overall dimensions corresponding to the overall dimensions of the top of the tray so that its margins may be adhesively secured on the top surface of the peripherial flange formation on the tray. The panel member constituting the cover is prepared for application by cutting on two parallel peripherial lines 72 and 73, with the cutting being to partial depth and on opposite faces of the panel. The cutting lines 72 and 73 are spaced from each other and inwardly of the peripherial edge of the flange formation on the tray side and end walls. The cutting lines are located, or spaced, as shown in FIG. 5 so as to define a peripherial marginal strip 74 of substantial width somewhat less than the width of the flange formation. The outside cutting on the line 72 is made to a depth which will substantially sever the paperboard portion 75 of the panel while the inside cutting on the line 73 is of sufficient depth to sever the film coating 76 leaving a strip area 77 between the two cutting lines of sufficient width to insure a proper sealing of the contents of the carton. A tear starting tab 78 (FIG. 2) is formed at one corner by interrupting the outer and inner cutting on lines 72 and 73 and cutting on the spaced outwardly directed lines 80 and 82 on the outside of the panel to the same depth as cutting line 72. This will enable the user to start the tearing along the partially cut lines by lifting the tab 78 upwardly (FIG. 3). The removal of the lid material defined by the cutting line 72 on the top face of the cover panel will leave intact on the flange the marginal strip 74 which is outboard of the tearing line 72 as a stiffener for the flange and the associated side wall panels. If the inside cutting 73 is sufficiently deep, as a result of inaccurate adjustment of cutting blades, which may occur, the tearing may leave on the tray flange some portions of the paperboard in the area between the cutting lines 72 and 73 along with the film material in this area, which is generally not objectionable.

In FIGS. 8 and 9 a modified form of lid or cover member 84 is illustrated in which the cutting on the spaced parallel peripherial lines 85 and 86 in the margin of the lid is uninterrupted and in one corner of the panel cuts are made on closely spaced U-shaped lines 87 and 88 which are of the same character as the cutting on lines 85 and 86 so as to define a tab area 90 which may be pressed inwardly with a finger so as to permit the panel material at 92 outboard of the tab 90 to be grapsed and pulled upwardly to start the tearing on the cutting lines 85 and 86 as illustrated in FIG. 9.

What is claimed is:

1. In a tray type container for packaging a product which is formed from a relatively light weight paperboard material with peripheral side walls upstanding from a bottom wall which side walls will buckle when subject to outwardly directed force and which have an outwardly directed narrow flange formation at the top edge thereof, a top cover forming lid member which has a periphery corresponding substantially to the outer periphery of the narrow flange formation, said cover forming member having a seal forming coating at least around the marginal portions which permits adhesively securing the marginal portions on the top face of the flange formation and said cover forming member having parallel spaced tearing line formations on the outer and inner faces extending around at least a major portion of the peripheral margin, the outermost tearing line formation being spaced from the peripheral edge a predetermined distance which is somewhat less that the width of said flange formation and the innermost tearing line extending adjacent the junction of the inner edge of the flange formation with the top edge of the side wall.

2. In a tray type container as set forth in claim 1, wherein the cover forming member has an innermost tearing line formation in which there are cuts which penetrate the coating and have a depth less than the thickness of the material.

3. In a tray type container as set forth in claim 1, wherein the cover forming member has an outermost tearing line in which there are cuts extending inwardly from the outermost face a distance less than the thickness of the cover material.

4. A cover member for closing the top of a tray fabricated from a cut and scored blank of foldable sheet material with side walls having a narrow flange formation at the top thereof, said cover member having overall dimensions corresponding substantially to the peripheral dimensions of the flange formation, so that when in top closing position on the said tray the margins of the cover member will rest on said flange formation, said cover member having in its marginal portions a pair of spaced, parallel tearing lines which are defined by cutting lines on opposite faces of the cover member, the cutting line of the outside face being located at a distance from the edge which is less than the width of the flange formation and having a depth approaching the thickness of the material, the cutting line on the inside face being located inwardly an appreciable distance from the outside cutting line so as to fall, on a line adjacent to the junction of the top and inner edges of the side wall and flange formation when the cover is positioned on the tray and means for adhesively securing the margins of the cover member on the tray flange formations which are outboard of the inner cutting line.

5. A cover member as set forth in claim 4 wherein said cover member is cut and scored at one corner thereof to provide a pull tab which may be readily grasped and torn loose from the tray flange so as to start of the tearing on the cutting lines and facilitate removal of the portion of the cover member defined by the cutting lines.

6. A cover member as set forth in claim 4 wherein the cutting lines of said cover are substantially continuous about the margin of the cover member and a tear out tab is provided adjacent one of the corners of the cover which is defined by generally U-shaped parallel cutting lines enabling said tab to be pushed in so as to provide access for a finger to grasp the adjacent material and start the tearing on the cutting lines.

* * * * *

UNITED STATES PATENT AND TRADEMARK OFFICE

CERTIFICATE OF CORRECTION

PATENT NO. : 4,351,473

DATED : September 28, 1982

INVENTOR(S) : Guelfo A. Manizza

It is certified that error appears in the above–identified patent and that said Letters Patent are hereby corrected as shown below:

Column 3, line 7 - "incresae" should be "increase".

Column 4, line 35 - "sa" should be "as".

Column 5, lines 9, 11, 15, 17, and 45 - the word "peripherial" should be "peripheral".

Signed and Sealed this

*Twenty-sixth* Day of *April 1983*

[SEAL]

*Attest:*

GERALD J. MOSSINGHOFF

*Attesting Officer*

*Commissioner of Patents and Trademarks*